US010614976B2

(12) United States Patent
Borgstrom et al.

(10) Patent No.: US 10,614,976 B2
(45) Date of Patent: Apr. 7, 2020

(54) REMOVABLE SHED SLEEVE FOR SWITCH

(71) Applicant: Thomas & Betts International, LLC, Wilmington, DE (US)

(72) Inventors: Alan D. Borgstrom, Hackettstown, NJ (US); Kieran Higgins, Great Meadows, NJ (US)

(73) Assignee: Thomas & Betts International LLC, Wilmington, DE (US)

( * ) Notice: Subject to any disclaimer, the term of this patent is extended or adjusted under 35 U.S.C. 154(b) by 1181 days.

(21) Appl. No.: 14/882,861

(22) Filed: Oct. 14, 2015

(65) Prior Publication Data

US 2016/0079010 A1 Mar. 17, 2016

Related U.S. Application Data

(62) Division of application No. 13/740,445, filed on Jan. 14, 2013, now Pat. No. 9,190,231.
(Continued)

(51) Int. Cl.
*H01H 11/00* (2006.01)
*H01B 17/26* (2006.01)
(Continued)

(52) U.S. Cl.
CPC ..... *H01H 11/00* (2013.01); *H01B 17/26* (2013.01); *H01H 31/023* (2013.01);
(Continued)

(58) Field of Classification Search
CPC .... H01H 11/00; H01H 31/023; H01H 33/662; H01H 2033/6623; H01H 2033/6665;
(Continued)

(56) References Cited

U.S. PATENT DOCUMENTS 3,898,372 A 8/1975 Kalb
4,527,028 A 7/1985 Luehring
(Continued)

FOREIGN PATENT DOCUMENTS

DE 19921477 A1 11/2000
FR 2868875 A1 10/2005
WO 0041199 A1 7/2000

*Primary Examiner* — Peter Dungba Vo
*Assistant Examiner* — Azm A Parvez
(74) *Attorney, Agent, or Firm* — Taft Stettinius & Hollister LLP; J. Bruce Schelkopf

(57) ABSTRACT

A method for assembling a housing for a high voltage electrical switch includes providing a tubular body having a top portion and a bottom portion opposite the top portion, wherein the tubular body is configured to receive a vacuum bottle assembly within the tubular body; sliding a first shed sleeve over an outside surface of the top portion without creating a permanent bond, wherein an interior surface of the first shed sleeve forms a dielectric interface between the outside surface of the top portion and the interior surface of the first shed sleeve; and sliding a second shed sleeve over an outside surface of the bottom portion without creating a permanent bond, wherein an interior surface of the second shed sleeve forms a dielectric interface between the outside surface of the bottom portion and the interior surface of the second shed sleeve.

19 Claims, 8 Drawing Sheets

Related U.S. Application Data

(60) Provisional application No. 61/605,808, filed on Mar. 2, 2012.

(51) Int. Cl.
*H01H 33/662* (2006.01)
*H01H 31/02* (2006.01)
*H01H 33/666* (2006.01)

(52) U.S. Cl.
CPC ... *H01H 33/662* (2013.01); *H01H 2033/6623* (2013.01); *H01H 2033/6665* (2013.01); *H01H 2223/00* (2013.01); *Y10T 29/49105* (2015.01)

(58) Field of Classification Search
CPC ..... H01H 2223/00; H01B 17/26; Y10T 29/49105; Y10T 29/49107; Y10T 29/49002
USPC ..... 29/622, 623, 592.1
See application file for complete search history.

(56) References Cited

U.S. PATENT DOCUMENTS 4,714,438 A 12/1987 Williams
4,724,284 A 2/1988 Wheeler
4,744,765 A 5/1988 DeLeo
4,822,289 A 4/1989 DeLeo
4,859,192 A 8/1989 DeLeo
4,896,008 A 1/1990 Aoki et al.
4,941,834 A 7/1990 DeLeo
5,131,855 A 7/1992 Pickering
5,214,249 A * 5/1993 Goch ..... H01B 17/06 174/141 R
5,563,379 A 10/1996 Kunieda et al.
5,667,060 A 9/1997 Luzzi
6,075,209 A 6/2000 Luzzi
6,091,040 A 7/2000 Mascher
6,172,317 B1 1/2001 Wristen
6,310,310 B1 10/2001 Wristen
6,485,326 B1 11/2002 Trainor et al.
6,952,154 B2 * 10/2005 Almgren ..... H01H 31/127 337/171
7,094,974 B2 8/2006 Ohkawa et al.
7,180,003 B2 2/2007 Almgren et al.
7,435,120 B2 10/2008 Janicke et al.
7,661,979 B2 2/2010 Hughes et al.
7,717,736 B2 5/2010 Chua et al.
7,772,515 B2 8/2010 Stoving et al.
7,883,356 B2 2/2011 Hughes et al.
7,909,635 B2 3/2011 Hughes et al.
8,038,457 B2 10/2011 Hughes et al.
8,049,129 B2 11/2011 Wristen et al.
2004/0155014 A1 8/2004 Schreiber et al.
2008/0174399 A1 * 7/2008 Benke ..... H01H 31/127 337/168
2012/0193325 A1 * 8/2012 Borgstrom ..... H01H 33/42 218/154

* cited by examiner

REMOVABLE SHED SLEEVE FOR SWITCH

CROSS-REFERENCE TO RELATED APPLICATION

This application is a divisional of and claims priority to U.S. application Ser. No. 13/740,445 filed on Jan. 14, 2013, which claims priority to U.S. Provisional Application No. 61/605,808 filed on Mar. 2, 2012, the disclosures of which are hereby incorporated herein by reference.

BACKGROUND OF THE INVENTION

The present invention relates to the field of electrical switches and more particularly to an electrical switch whose contacts are located within an insulating environmental enclosure, such as a ceramic bottle. One of the contacts may be actuated by a mechanical system located outside of the enclosure connected by a shaft extending through an enclosure seal.

In conventional systems, the base of the switch containing the actuating mechanisms typically forms a ground connection and, unless precautions are taken, high voltage may arc from the switch poles to the actuating mechanism, causing failure or damage. To address this, conventional high voltage switches, such as overhead reclosers, typically utilize an outer insulating shield with a number of radially extending fins for increasing creep and flashover distance on the exterior of the switch housing.

DETAILED DESCRIPTION OF THE PREFERRED EMBODIMENTS

The following detailed description refers to the accompanying drawings. The same reference numbers in different drawings may identify the same or similar elements.

Systems and/or methods described herein related to a housing for a high voltage electrical switch. The housing includes a tubular body having a top portion and a bottom portion opposite the top portion and removable shed sleeves. A first shed sleeve may be removably attached to an outside surface of the top portion, such that an interior surface of the first shed sleeve forms a dielectric interface between the outside surface of the top portion and the interior surface of the first shed sleeve. Similarly, a second shed sleeve may be removably attached to an outside surface of the bottom portion, such that an interior surface of the second shed sleeve forms a dielectric interface between the outside surface of the bottom portion and the interior surface of the second shed sleeve. The first and second shed sleeves may be stretched over their respective portions of the tubular body and may be secured via an interference fit.

Figure 1:
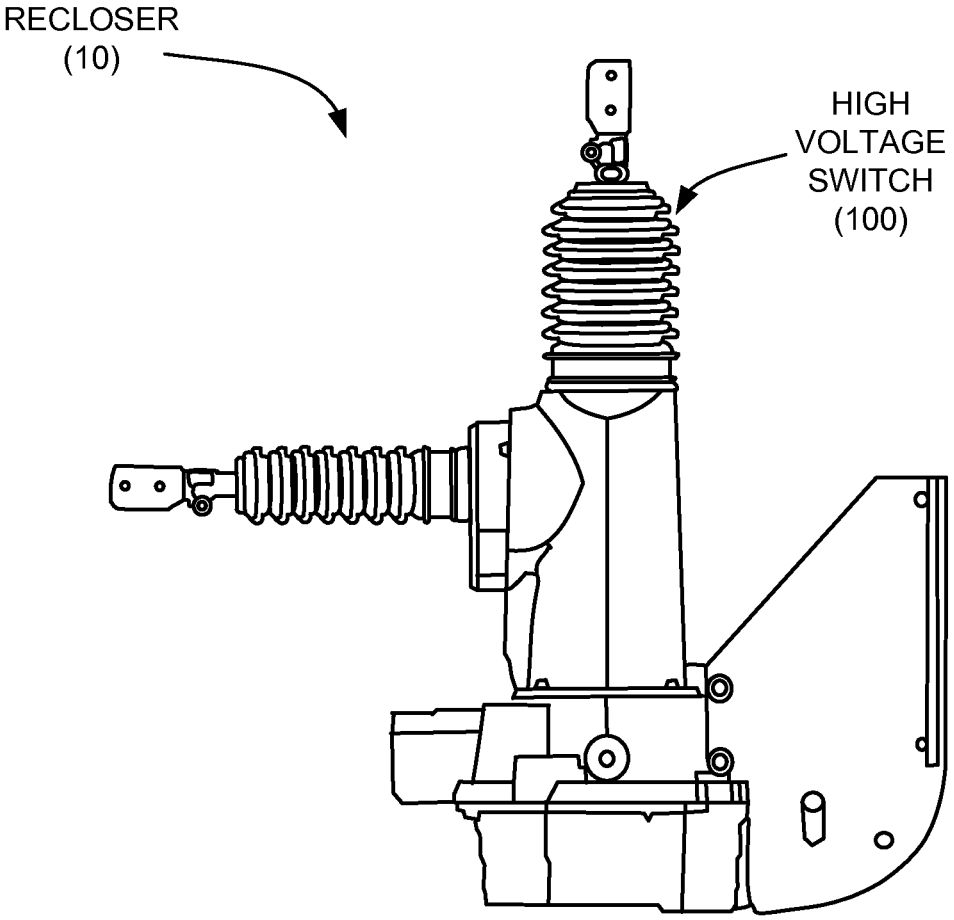
FIG. 1 is a diagram of an exemplary assembly in which systems and/or methods described herein may be implemented.

FIG. 1 provides a diagram of an exemplary device 10 in which systems and/or methods described herein may be implemented. In one implementation, device 10 may include a recloser assembly. Device 10 may generally be viewed as a circuit breaker equipped with a mechanism that can automatically close the circuit breaker after the breaker has been opened due to a fault. Reclosers may be used, for example, on overhead power distribution systems. Since many short-circuits on overhead lines clear themselves, a recloser can improve service continuity by automatically restoring power to a line after a momentary fault.

Device 10 may include a high voltage switch 100 with insulator sheds to prevent voltage flashover or voltage tracking due to moisture and contamination. As used in this disclosure with reference to the apparatus (e.g., switch 100), the term "high voltage" refers to equipment configured to operate at a nominal system voltage above 3 kilovolts (kV). Thus, the term "high voltage" refers to equipment suitable for use in electric utility service, such as in systems operating at nominal voltages of about 3 kV to about 38 kV, commonly referred to as "distribution" systems, as well as equipment for use in "transmission" systems, operating at nominal voltages above about 38 kV.

In conventional switches, the insulator sheds are integral to the insulator housing of the switch. These integrated housings/sheds may be made of either a porcelain or epoxy material. The porcelain or epoxy material is susceptible to breaking and cannot be repaired. Thus, replacement of an integrated housing/shed may require costly replacements for even minor damage.

Figure 2:
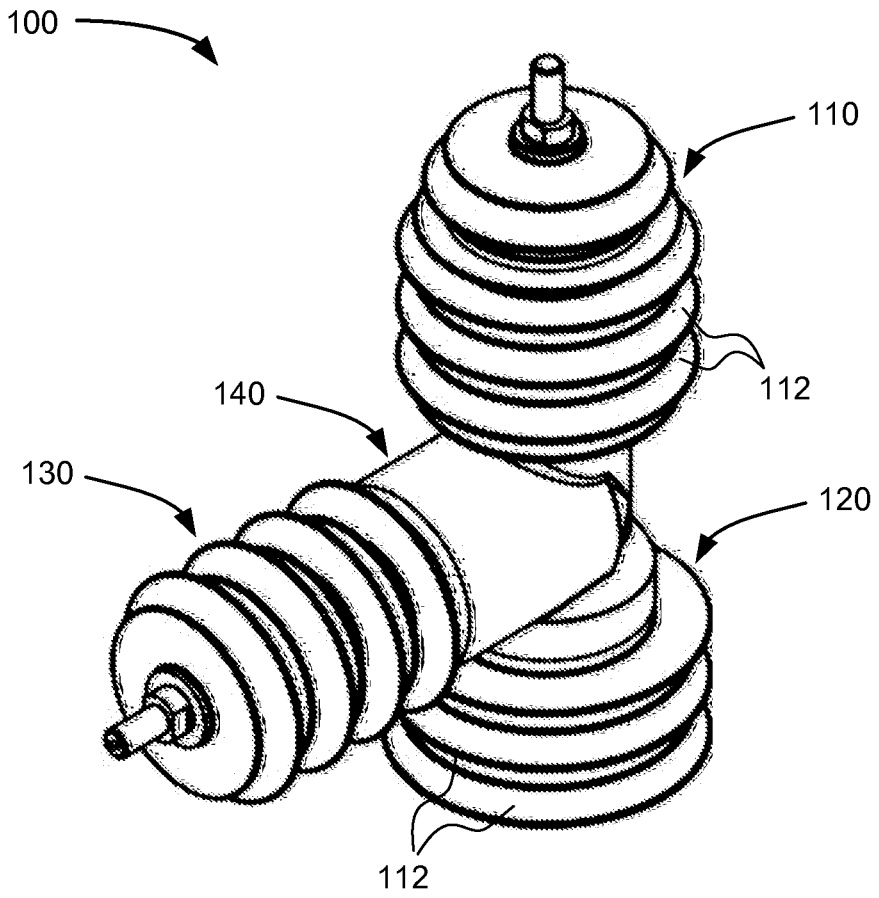
FIG. 2 is an isometric diagram illustrating a high voltage switch according to an implementation described herein.

FIG. 2 is an isometric diagram illustrating high voltage switch 100 according to an implementation described herein. As shown in FIG. 2, high voltage switch 100 may include a top shed sleeve 110, a bottom shed sleeve 120, and a side terminal sleeve 130 each surrounding portions of an insulator housing 140. Any of top shed sleeve 110, bottom shed sleeve 120, and side terminal sleeve 130 may include a flexible sleeve that is separate from insulator housing 140 and may be removably secured over insulator housing 140. Top shed sleeve 110, bottom shed sleeve 120, and side terminal sleeve 130 may be made from, for example, a dielectric silicone, elastomer or rubber, which is vulcanized under heat and pressure, such as ethylene-propylene-dienemonomer (EPDM) elastomer. In some implementations, high voltage switch 100 may include a combination of removable shed sleeves and integrated shed sleeves. For example, in one implementation, top shed sleeve 110 and bottom shed sleeve 120 may be included as removable components, while side terminal sleeve 130 may be provided in an integrated (e.g., conventional) configuration.

As shown in FIG. 2, in some implementations, top shed sleeve 110, bottom shed sleeve 120, and side terminal sleeve 130 may each include a number of radially extending fins 112 for increasing a creep distance on an exterior of insulator housing 140. Fins 112 may be desirable in above-ground or weather-exposed switch installations, such as overhead switches or reclosers. Increased creep distance may be provided, for example, by changing the spacing and/or dimensions of fins 112 on top shed sleeve 110, bottom shed sleeve 120, or side terminal sleeve 130. In implementations described herein, top shed sleeve 110, bottom shed sleeve 120, and/or side terminal sleeve 130 may be provided in multiple configurations such that the creep properties of high voltage switch 100 can be altered by changing one or more of top shed sleeve 110, bottom shed sleeve 120, and side terminal sleeve 130. For example, an increased creep distance for high voltage switch 100 may be achieved by replacing top shed sleeve 110 with a different top shed sleeve having larger, more, and/or differently spaced fins 112.

Figure 3:
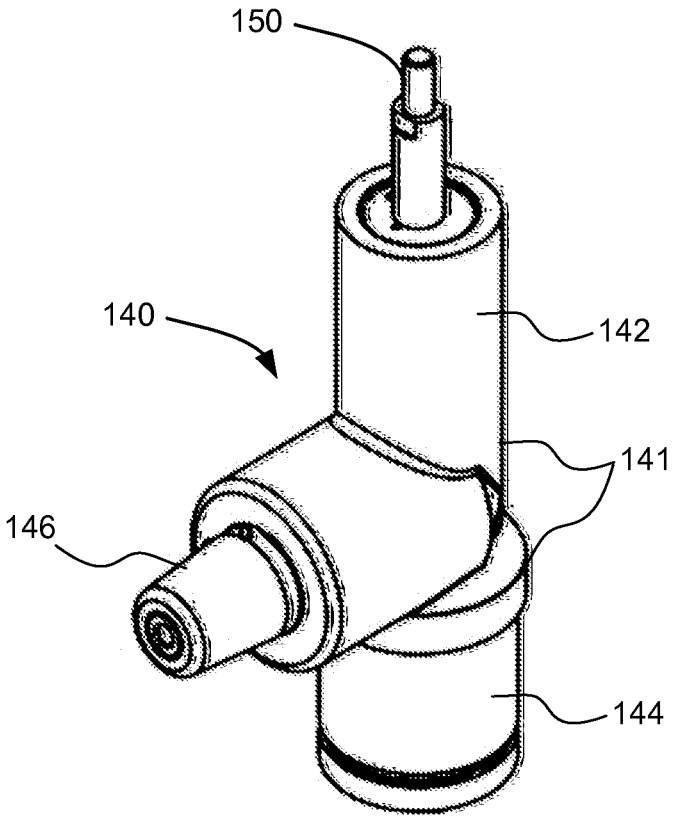
FIG. 3 is an isometric diagram illustrating a housing of the high voltage switch of FIG. 2.

Insulator housing 140 may generally include a tubular configuration to receive switching components of high voltage switch 100. FIG. 3 is an isometric diagram illustrating housing 140 of high voltage switch 100 without top shed sleeve 110, bottom shed sleeve 120, or side terminal sleeve 130 attached. Insulator housing 140 may include a tube 141 having a top portion 142, a bottom portion 144, and a side terminal interface 146. Tube 141 may define an elongated bore extending axially through top portion 142 and bottom portion 144 of insulator housing 140 to receive internal components of high voltage switch 100. As shown in FIG. 3, a contact assembly 150 may extend out of insulator housing 140 to receive a terminal thereon. The terminal (not shown) may be configured to further couple to a contact assembly of a bushing or another device. Insulator housing 140 may provide structural support to the internal components. Insulator housing 140 may include an insulating material such as an epoxy, ceramic, porcelain, silicone rubber, an EPDM elastomer, etc.

Figure 4:
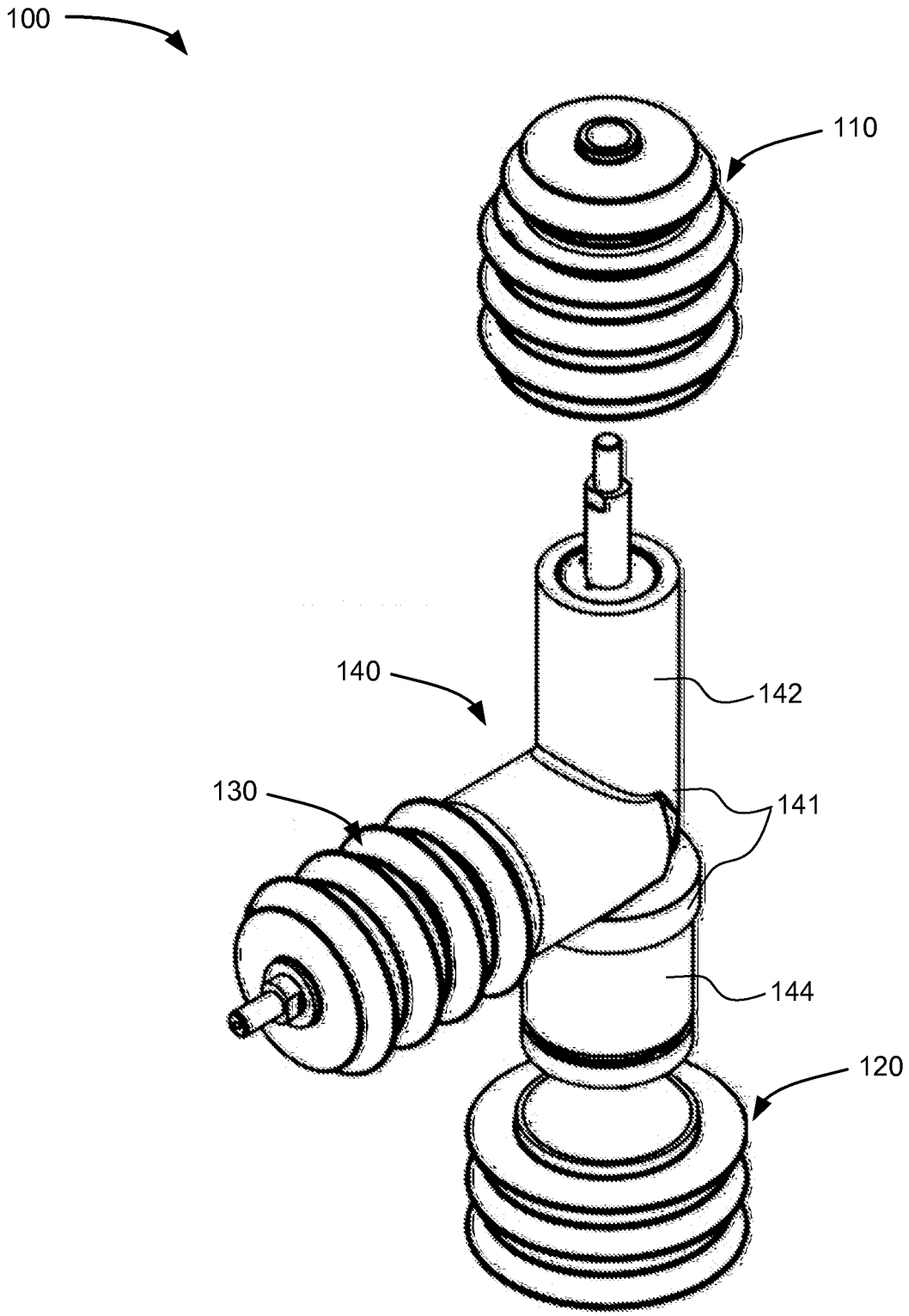
FIG. 4 is a partial assembly view of the high voltage switch of FIG. 2.

FIG. 4 is a partial assembly view of high voltage switch 100 including top shed sleeve 110, bottom shed sleeve 120, and side terminal sleeve 130 applied to insulator housing 140. Outer surfaces of top portion 142 and bottom portion 144 are generally smooth and cylindrical to provide clean contact with interior surfaces of top shed sleeve 110 and bottom shed sleeve 120. As shown in FIG. 4, top shed sleeve 110 and bottom shed sleeve 120 may slide over top portion 142 and bottom portion 144, respectively. Top shed sleeve 110 and bottom shed sleeve 120 may be held in place on insulator housing 140 via an interference fit. That is, top shed sleeve 110 and bottom shed sleeve 120 may have a central bore with a circumference sized such that it may be stretched over the circumference of top portion 142 and bottom portion 144. The interference fit provides a substantially void-free dielectric interface between the outside surface of insulator housing 140 and the interior surfaces of shed sleeves 110/120 without creating a permanent bond.

Figure 5:
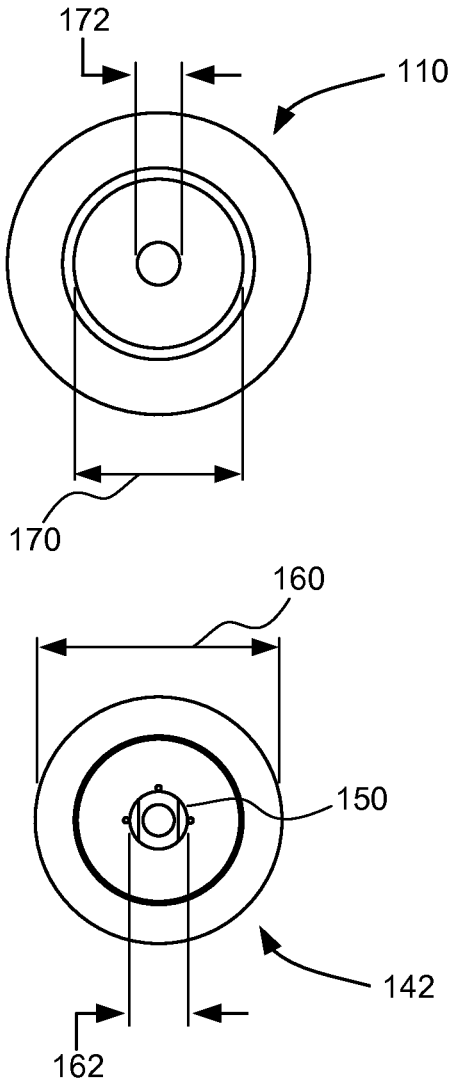
FIG. 5 provides a bottom view of a top shed sleeve and a top view of a top portion of the high voltage switch of FIG. 2.

FIG. 5 provides a bottom view of top shed sleeve 110 and a top view of top portion 142. As shown in FIG. 5, the outside diameter 160 of top portion 142 is larger than the inside diameter 170 that defines the bottom opening of top shed sleeve 110. Similarly, the outside diameter 162 of contact assembly 150 may be larger than the diameter 172 that defines the top opening of top shed sleeve 110. The interior surface of top shed sleeve 110 is generally smooth and cylindrical. Thus, top shed sleeve 110 can be stretched, manipulated, and/or forced over top portion 142 and contact assembly 150 to provide an airtight/watertight fit. The interference fit between top portion 142 and top shed sleeve 110 (e.g., generally indicated by reference number 145) may provide a dielectric interface between top portion 142 and top shed sleeve 110. Bottom shed sleeve 120 may be similarly configured to stretch over bottom portion 144, although the dimensions of bottom shed sleeve 120 and bottom portion 144 may differ from that of top shed sleeve 110 and top portion 142.

Figure 6:
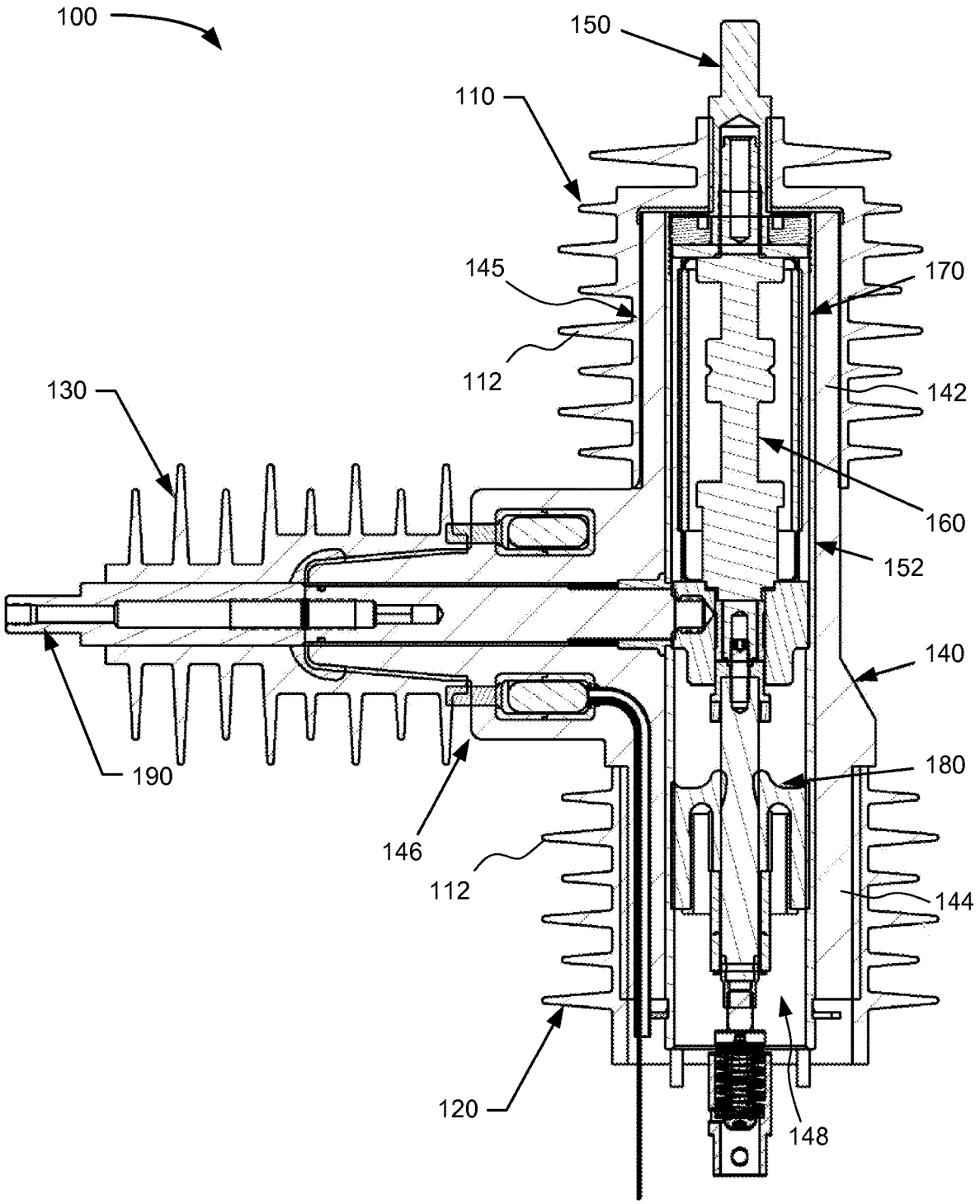
FIG. 6 is a schematic cross-sectional diagram the high voltage switch of FIG. 2.

FIG. 6 is a schematic cross-sectional diagram illustrating high voltage switch 100 configured in a manner consistent with implementations described herein. FIG. 6 illustrates switch 100 in an engaged (e.g., "on") configuration. As shown in FIG. 6, high voltage switch 100 may include top shed sleeve 110, bottom shed sleeve 120, side terminal sleeve 130, insulator housing 140, top contact assembly 150, a vacuum bottle assembly 160, an interior sleeve 170, a diaphragm 180, and a side contact assembly 190.

Top portion 142 and bottom portion 144 of housing 140 may define an elongated bore 148 extending axially through housing 140. High voltage switch 100 may be configured to provide selectable connection between top contact assembly 150 and side contact assembly 190. More particularly, high voltage switch 100 may be configured to provide mechanically moveable contact between contact assembly 150 and contact assembly 190.

Within housing 140, high voltage switch 100 may include a rigid reinforcing sleeve 152 that extends substantially the entire length of bore 148. Consistent with implementations described herein, reinforcing sleeve 152 may be formed from a dielectric material having high physical strength such as fiber reinforced thermosetting polymers, fiber reinforced thermoplastic polymers, and high strength polymers. Among the materials that can be used for reinforcing sleeve 152 are fiberglass reinforced epoxy, polyamides, polyvinyl chloride, and ultra high molecular weight polyethylene.

In one implementation, reinforcing sleeve 152 may include rings, protrusions, and/or threads on the inside surface to support other components of high voltage switch 100, such as vacuum bottle assembly 160. As shown, reinforcing sleeve 152 includes an opening aligned with a bore of side terminal interface 146.

Vacuum bottle assembly 160 may include a tubular ceramic bottle having a fixed end closure adjacent contact assembly 150 and an operating end closure disposed at the opposite, operating end of the tubular ceramic bottle. Generally, the vacuum bottle is hermetically sealed, such that bottle and contacts therein are maintained gas-tight throughout the use of high voltage switch 100. In addition, the interior space within the vacuum bottle has a controlled atmosphere therein. The term "controlled atmosphere" refers an atmosphere other than air at normal atmospheric pressure. For example, the atmosphere within the vacuum bottle may be maintained at a subatmospheric pressure. The composition of the atmosphere may also differ from normal air. For example, the vacuum bottle may include arc-suppressing gases such as $SF_6$ (sulphur hexafluoride).

As shown in FIG. 6, an exterior diameter of vacuum bottle assembly 160 may be sized slightly less than an interior diameter of reinforcing sleeve 152. The resulting annular space between the outside of the bottle and the inside of the reinforcing element is filled by interior sleeve 170. Interior sleeve 170 may be inserted over vacuum bottle assembly 160 prior to installation of vacuum bottle assembly 160 (e.g., into top portion 142 of insulator housing 140). Upon installation of vacuum bottle assembly 160 within reinforcing sleeve 152, the annular space between vacuum bottle assembly 160 and reinforcing sleeve 152 is completely filled by interior sleeve 170, so as to provide a substantially void-free dielectric interface between the outside of the bottle and the inside of the reinforcing element. Interior sleeve 170 may be formed of a dielectric material different from or the same as the dielectric material of insulator housing 140. For example, interior sleeve 170 may be formed from a silicon rubber.

Figure 7:
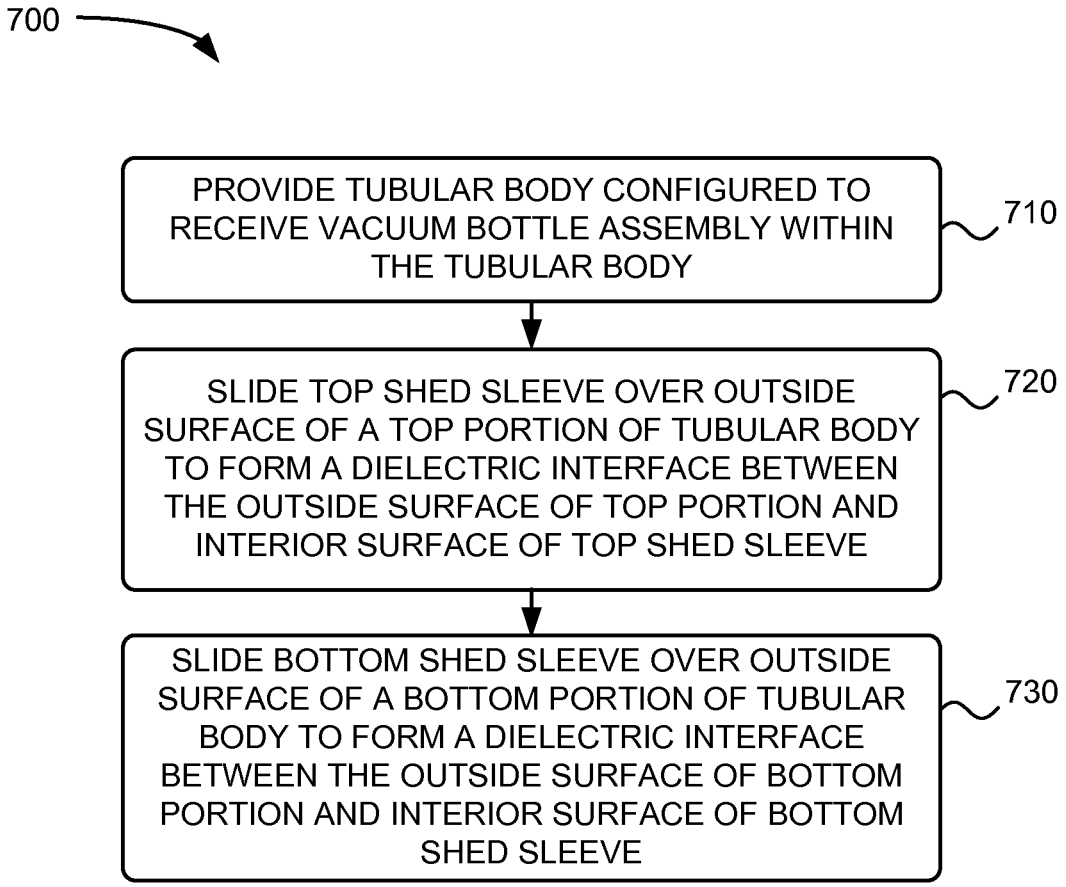
FIG. 7 is a flow diagram of a method for assembling a high voltage switch according to an implementation described herein.

FIG. 7 is a flow diagram of an exemplary process for assembling a housing for high voltage electrical switch 100 according to an implementation described herein. As shown in FIG. 7, process 700 may include providing a tubular body configured to receive a vacuum bottle assembly within the tubular body (block 710). For example, insulator housing 140 may be molded from a dielectric material as described above. The tubular body may include a top portion (e.g., top portion 142) and a bottom portion (e.g., bottom portion 144) with outer surfaces that are devoid of fins or other radially extending protrusions.

Process 700 may further include sliding a top shed sleeve over an outside surface of a top portion of the tubular body to form a dielectric interface between the outside surface of the top portion and the interior surface of the top shed sleeve (block 720). For example, a separate shed sleeve (e.g., top shed sleeve 110) may be applied over the outer surface of a top portion (e.g., top portion 142) of the housing. The shed sleeve may include a smooth interior surface and radially extending fins (e.g., fins 112) on an outer surface. The shed sleeve may also include a smaller inside diameter than that of the outer surface of a top portion 142. Thus, the shed sleeve may be stretched over top portion 142 and be secured via an interference or friction fit. The interference fit (indicated, for example, by reference number 145) may provide a substantially void-free dielectric interface between the shed sleeve and the top portion 142.

Process 700 may further include sliding a bottom shed sleeve over an outside surface of a bottom portion of the tubular body to form a dielectric interface between the outside surface of the bottom portion and the interior surface of the bottom shed sleeve (block 730). For example, a separate shed sleeve (e.g., bottom shed sleeve 120) may be applied over the outer surface of a bottom portion (e.g., bottom portion 144) of the housing. The shed sleeve may include a smooth interior surface and radially extending fins (e.g., fins 112) on an outer surface. The shed sleeve may also include a smaller inside diameter than that of the outer surface of a bottom portion 144. Thus, the shed sleeve may be stretched over bottom portion 144 and be secured via an interference fit. The interference or friction fit may provide a substantially void-free dielectric interface between the shed sleeve and the bottom portion 144. In one implementation, side terminal sleeve 130 may also be slid over a portion of side terminal interface 146 in a similar manner.

Figure 8:
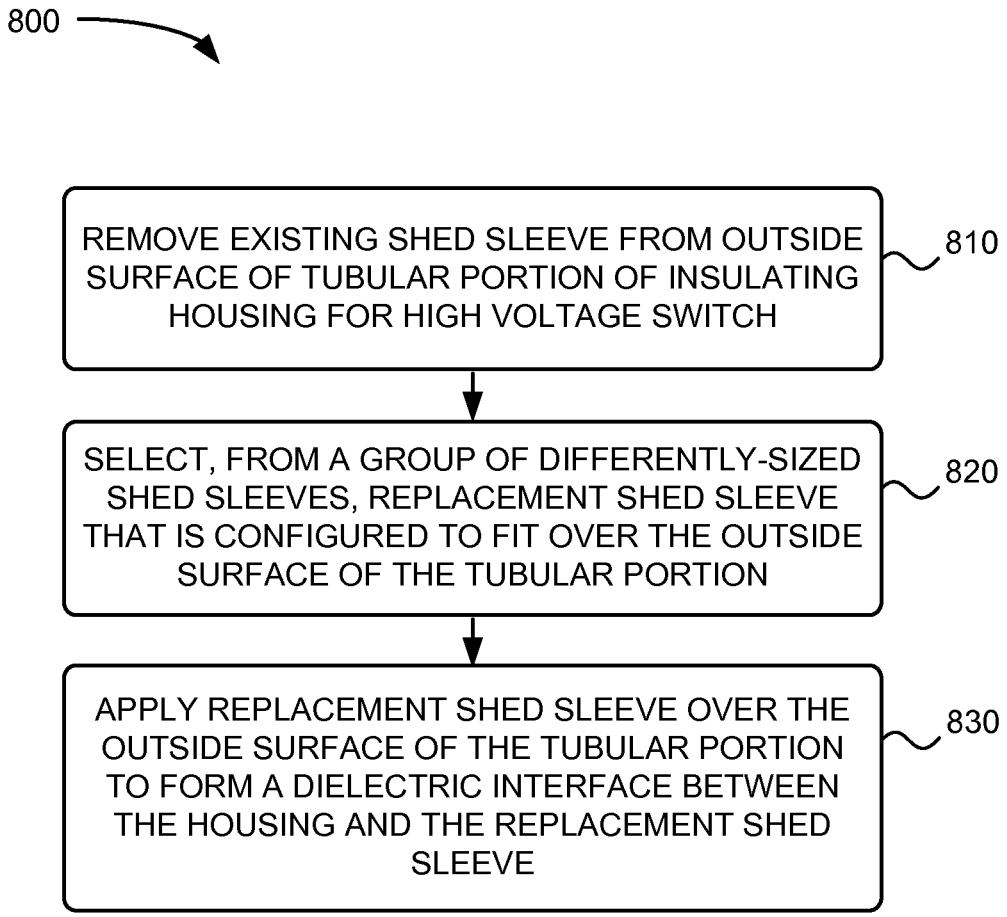
FIG. 8 is a flow diagram of an exemplary process for replacing a shed sleeve for a high-voltage electrical switch housing according to an implementation described herein.

FIG. 8 is a flow diagram of an exemplary process for replacing a shed sleeve for a high-voltage electrical switch housing according to an implementation described herein. As shown in FIG. 8, process 800 may include removing an existing shed sleeve from an outside surface of a tubular portion of an insulating housing for the high voltage switch (block 810). For example, a shed sleeve (e.g., shed sleeve 110) of high voltage switch 100 may become damaged due to external conditions, a molding defect, etc. Because there is no permanent bond between the damaged shed sleeve and the underlying housing (e.g., insulator housing 140), the damaged shed sleeve may be removed by simply sliding off or cutting the damaged shed sleeve without causing damage to the housing.

Process 800 may further include selecting, from a group of different types of shed sleeves, a replacement shed sleeve that is configured to fit over the outside surface of the tubular portion (block 820). For example, because the shed sleeves and the underlying housing are separate components, multiple shed sleeve configurations may be provided for the same housing. For example, shed sleeves may be selected based on a preferred material type (e.g., silicon or EPDM rubber) and/or a particular fin configuration (or creep distance). Additionally, or alternatively, a single shed sleeve configuration may be applicable to more than one type of insulator housing. A field technician, for example, may select a particular replacement shed sleeve (e.g., top shed sleeve 110) from a variety of shed sleeve types that may be applicable for a particular high voltage switch 100 (e.g., select a shed sleeve with a certain number of fins 112 or distance between the fins 112).

Process 800 may further include applying the replacement shed sleeve over the outside surface of the tubular portion to form a dielectric interface between the housing and the replacement shed sleeve (block 830). For example, after cleaning or otherwise preparing the surface of the insulator housing (e.g., top portion 142), the replacement shed sleeve (e.g., top shed sleeve 110) may be applied over the insulator housing with an interference fit. The interference fit may provide a substantially void-free dielectric interface between the shed sleeve and the top portion 142. Although process 800 is described above in connection with replacement of top shed sleeve 110, the process may be equally applicable to replacement of bottom shed sleeve 120 and/or side terminal sleeve 130.

By providing a base insulator housing with shed sleeves and removable components, sheds of high voltage switches may be replaced with significant cost savings over a total switch replacement. Similarly, scrap from molding defects during manufacturing can be reduced by eliminating instances where an entire housing must be scrapped due to defects in a shed. Furthermore, material types (e.g., silicone or EPDM) for sheds may be easily adapted to meet customer requirements.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments. For example, implementations described herein may also be used in conjunction with other devices, such as low, medium, or high voltage switchgear equipment, including 0-3 kV, 15 kV, 25 kV, 35 kV or higher equipment.

For example, various features have been mainly described above with respect to high voltage switches in both overhead and underground switchgear environments. In other implementations, other medium/high voltage power components may be configured to include the removable shed sleeve configurations described above.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A method for assembling a housing for a high voltage electrical switch, the method comprising:

providing a tubular body having an integrated shed sleeve, a first portion, a second portion, wherein the tubular body is configured to receive a vacuum bottle assembly within the tubular body, and wherein the integrated shed sleeve is integral to the tubular body, the integrated shed sleeve, the first portion, and the second portion being positioned along different portions of the tubular body;

sliding a first shed sleeve over an outside surface of the first portion without creating a permanent bond, wherein an interior surface of the first shed sleeve forms a dielectric interface between the outside surface of the first portion and the interior surface of the first shed sleeve, and wherein the first shed sleeve includes a plurality of radially extending fins;

sliding a second shed sleeve over an outside surface of the second portion without creating a permanent bond, wherein an interior surface of the second shed sleeve forms a dielectric interface between the outside surface of the second portion and the interior surface of the second shed sleeve, selecting the first shed sleeve from a group of shed sleeves having creep distances between fins of the first shed sleeve that are different than creep distances between a plurality of radially extending fins of the integrated shed sleeve.

2. The method of claim 1, wherein the first shed sleeve is retained on the outside surface of the first portion via an interference or friction fit, and wherein the second shed sleeve is retained on the outside surface of the second portion via an interference or friction fit.

3. The method of claim 1, further comprising:

selecting the first shed sleeve from a group of shed sleeves including ethylene-propylene-dienemonomer (EPDM) elastomer shed sleeves and silicone shed sleeves based on an outer diameter of the first portion, and selecting the second shed sleeve from another group of shed sleeves including ethylene-propylene-dienemonomer (EPDM) elastomer shed sleeves and silicone shed sleeves based on an outer diameter of the second portion.

4. The method of claim 1, wherein the second shed sleeve includes a plurality of radially extending fins, and wherein the method further comprises:

selecting one of the first shed sleeve and the second shed sleeve from a group of shed sleeves having creep distances between fins that are different than creep distances between fins of the other of the first shed sleeve and the second shed sleeve.

5. The method of claim 1, wherein the outside surface of the first portion includes a first outside diameter, wherein the first shed sleeve includes a first opening with a first inside diameter that is smaller than the first outside diameter, wherein sliding the first shed sleeve over the outside surface of the first portion includes stretching the first shed sleeve over the first outside diameter of the first portion, and wherein the integrated shed sleeve extends in a direction along the tubular body that is non-parallel to a direction of at least one of the first portion and the second portion.

6. The method of claim 1, wherein the outside surface of the second portion includes a second outside diameter, wherein the second shed sleeve includes a second opening with a second inside diameter that is smaller than the second outside diameter, wherein sliding the second shed sleeve over the outside surface of the second portion includes stretching the second shed sleeve over the second outside diameter of the second portion, and wherein the integrated shed sleeve extends in a direction along the tubular body that is non-parallel to a direction of at least one of the first portion and the second portion.

7. A method for assembling a housing for a high voltage electrical switch, the method comprising:

providing a tubular body having at least a first portion, the tubular body further including an integrated shed sleeve that is integral to the tubular body, the first portion and the integrated shed sleeve being positioned along different portions of the tubular body, wherein the tubular body is configured to receive a vacuum bottle assembly within the tubular body;

sliding a first shed sleeve over an outside surface of the first portion without creating a permanent bond, wherein an interior surface of the first shed sleeve forms a dielectric interface between the outside surface of the first portion and the interior surface of the first shed sleeve, and wherein the first shed sleeve is retained on the outside surface of the first portion via an interference or friction fit; and selecting the first shed sleeve from a group of shed sleeves based on a creep distance between a plurality of radially extending fins of the first shed sleeve being different than a creep distance between a plurality of radially extending fins of the integrated shed sleeve.

8. The method of claim 7, wherein the outside surface of the first portion has a first outside diameter, wherein the first shed sleeve includes a first opening with a first inside diameter that is smaller than the first outside diameter, and wherein sliding the first shed sleeve over the outside surface of the first portion includes stretching the first shed sleeve over the first outside diameter of the first portion.

9. The method of claim 7, wherein the first shed sleeve comprises one of an ethylene-propylene-dienemonomer (EPDM) elastomer or silicone, and wherein the tubular body further includes a side interface, the first portion being non-parallel to the side interface, the method further comprising:

sliding a second shed sleeve over an outside surface of the side interface without creating a permanent bond, wherein an interior surface of the second shed sleeve forms a dielectric interface between the outside surface of the side interface and the interior surface of the second shed sleeve, and wherein the second shed sleeve is retained on the outside surface of the side interface via an interference or friction fit.

10. The method of claim 7, further comprising:

removing the first shed sleeve from the outside surface of the first portion; and installing, over the outside surface of the first portion, a replacement shed sleeve that includes a plurality of radially extending fins, wherein the replacement shed sleeve is retained on the outside surface of the first portion via an interference fit.

11. The method of claim 10, wherein the replacement shed sleeve includes an ethylene-propylene-dienemonomer (EPDM) elastomer, silicone, or a thermoplastic elastomer.

12. The method of claim 10, further comprising:

selecting, from a plurality of differently-sized shed sleeves, the replacement shed sleeve that is configured to fit over the outside surface of the first portion.

13. The method of claim 10, wherein the replacement shed sleeve forms a dielectric interface between the outside surface of the first portion and an interior surface of the replacement shed sleeve.

14. The method of claim 10, wherein the plurality of radially extending fins for the replacement shed sleeve include a second creep distance that is different than the creep distance between the plurality of radially extending fins of the first shed sleeve.

15. The method of claim 10, wherein the removing is performed without a structural change to the outside surface of the first portion.

16. The method of claim 10, further comprising:

providing the high voltage electrical switch, and wherein the first portion is a top portion of the tubular body.

17. The method of claim 10, wherein the outside surface of the first portion has a first outside diameter, wherein the replacement shed sleeve includes a first opening with a first inside diameter that is smaller than the first outside diameter, and wherein installing the replacement shed sleeve includes stretching the first opening of the replacement shed sleeve over the first outside diameter of the first portion.

18. The method of claim 7, wherein the tubular body includes a second portion opposite the first portion, the method further comprising:

sliding a second shed sleeve over an outside surface of the second portion without creating a permanent bond, wherein an interior surface of the second shed sleeve forms a dielectric interface between the outside surface of the second portion and the interior surface of the second shed sleeve, and wherein the second shed sleeve is retained on the outside surface of the second portion via an interference or friction fit.

19. A method for assembling a housing for a high voltage electrical switch, the method comprising:

providing a tubular body having at least a first portion and an integrated shed sleeve that is integral to the tubular body, the first portion and the integrated shed sleeve being positioned along different portions of the tubular body, wherein the tubular body is configured to receive a vacuum bottle assembly within the tubular body;

sliding a first shed sleeve over an outside surface of the first portion without creating a permanent bond, wherein an interior surface of the first shed sleeve forms a dielectric interface between the outside surface of the first portion and the interior surface of the first shed sleeve, wherein the first shed sleeve is retained on the outside surface of the first portion via an interference or friction fit, and wherein the first shed sleeve includes a plurality of radially extending fins; and selecting the first shed sleeve from a group of shed sleeves having creep distances between fins that are different than creep distances between a plurality of radially extending fins of the integrated shed sleeve.

* * * * *